US006170686B1

(12) United States Patent
Flores

(10) Patent No.: US 6,170,686 B1
(45) Date of Patent: Jan. 9, 2001

(54) DEMOUNTABLE WIRE MESH CONTAINER FOR BOTTLES

(75) Inventor: Sebastian Flores Flores, Navarra (ES)

(73) Assignee: Sagarte, S. A., Navarra (ES)

( * ) Notice: Under 35 U.S.C. 154(b), the term of this patent shall be extended for 0 days.

(21) Appl. No.: 09/536,080

(22) Filed: Mar. 24, 2000

(30) Foreign Application Priority Data

Mar. 23, 1999 (EP) ..... 00500006

(51) Int. Cl.[7] ..... B25D 21/02
(52) U.S. Cl. ..... 220/4.33; 220/4.34; 220/495
(58) Field of Search ..... 220/4.33, 4.34, 220/7, 494, 495, 485; 211/181.1, 194

(56) References Cited

U.S. PATENT DOCUMENTS 2,804,227 * 8/1957 Elfgren ..... 220/4.34
3,401,814 * 9/1968 Chiswell et al. ..... 220/4.33
3,428,204 * 2/1969 Wilson ..... 220/4.34
3,442,231 * 5/1969 Jurasek ..... 220/495
4,662,532 * 5/1987 Anderson et al. ..... 220/495
5,597,084 * 1/1997 Parasin ..... 220/4.33
5,642,830 * 7/1997 Foster ..... 220/4.33

FOREIGN PATENT DOCUMENTS

9500808 U 3/1995 (ES) .
9700777 U 3/1997 (ES) .

* cited by examiner

*Primary Examiner*—Joseph M. Moy
(74) *Attorney, Agent, or Firm*—Brinks Hofer Gilson & Lione

(57) ABSTRACT

The container has a pallet-like base platform (1), provided with short vertical tubes (5) at its vertices, into which two side panels (7–7') can be inserted, which are definitively secured to the base platform with the aid of pressure-activated joining clips (16–17), while the back wall (20) and front wall (21) are subsequently secured to said side panels (7–7') with the aid of clamping pins (24), formed by a roughly rectangular rod, open at one of its vertices, one of whose end sections can be fitted into aligned holes (18–19) on the panels, while the rest of the rod acts as a clamp which appropriately connects the vertical posts to be joined. Thus, the container is easily assembled and disassembled without threaded fasteners, by means of the aforementioned clips (16) and clamping pins (24).

25 Claims, 4 Drawing Sheets

DEMOUNTABLE WIRE MESH CONTAINER FOR BOTTLES

BACKGROUND

This invention refers to a container or bin to hold bottles, of the type used in wine aging, a container with considerable capacity that, once the appropriate number of bottles has been placed in its interior, can be tilted 90° so that the bottles can be positioned horizontally during aging.

The purpose of the invention is to achieve a metal container whose different component parts can be easily disassembled, but whose assembly and disassembly can be carried out extremely quickly and easily, without threaded fasteners or other auxiliary means which might significantly slow down these operations.

Bearing in mind the problem that the use of wooden bottle containers/racks implies, especially in wine cellars, due to the fact that the wood cannot be appropriately treated against certain natural enemies such as moths or borers, insects naturally destructive to wood, in due course metal bottle containers/racks came into use, where said bottles are kept for the period necessary for aging.

In this sense, the Spanish Utility Model with application number U9500808 should be mentioned, in which the container is constructed, as is customary, by means of a metal grid which makes up the base of the container and four other grids which make up its sides; these elements are provided with multiple holes which, as they are aligned with each other, allow them to be secured to each other by means of threaded fasteners and their corresponding nuts; the number of threaded fasteners used is, at a minimum, sixteen, which evidently implies that assembling and disassembling the container is an extremely laborious task. These actions must be carried out periodically, as at the end of each phase of aging the containers are disassembled for storage, so that they take up the least possible space, and must then be re-assembled when the bottling of a new harvest takes place.

The applicant company is at the same time the owner of the Spanish Utility Model with application number U9700777, in which a bottle container/rack module of the aforementioned type is described, whose characteristics focus on the means of securing a fifth metal grid which is independent of the container itself and acts as a holding lid for the bottles, as well as on the means of securing the typical side gate, specifically by using lock slide fasteners with springs, which considerably speeds up the handling of these elements.

However, the basic structure of the container, in other words, the securing of the different metal grids which make up the body of the former to each other, is still done by means of threaded fasteners passing through holes which are aligned with each other, with the aforementioned problem.

On the other hand, containers as we have known them up to now, apart from the means that may be used for their assembly/disassembly, have as a common denominator a fixed capacity, so that those containers that are intended for storage of bottles of the "Bordeaux" type are not suitable for storing bottles of the "Burgundy" type, and vice-versa, which forces the owners of wine cellars to have two different types of containers, which means added complexity, greater investment costs, the impossibility of using empty containers if they are not the right type, etc.

SUMMARY

The demountable wire mesh container for bottles which this invention proposes solves the aforementioned problem in a completely satisfactory manner, in such a way that its simple structure allows assembly and disassembly operations to be carried out extremely quickly and simply, with no threaded fasteners at all.

To achieve this, more specifically, the proposed container starts with a basic construction which is similar to any container of this type, in other words, it has a base platform, in the form of a grid, upon which the four lateral panels, also in the form of a grid, which make up its sides, also lateral, are mounted; one of these is divided into two sections, superposed and hinged, which form a top half drop gate; and starting from this basic and generic construction, it has the following characteristics:

The aforementioned base platform has a pallet-like metal structure, with a rectangular frame as its basic element, to which a grid which makes up the support area for the bottles is appropriately secured, and is provided with legs on its lower surface to lift it off the ground, with the particularity that said frame incorporates a vertical tube at each of its vertices, open on top and designed to have the side panels of the container fitted into them; each of these panels has two vertical posts, each terminating in a shank of the appropriate size and dimensions to snugly fit into the vertical tubes of the base platform.

Each one of the side panels incorporates a lower transverse rod, whose ends are higher than the main rod, allowing it to be secured to the respective vertical posts, while leaving the shanks which are to be inserted into the base platform free; these side panels are stabilized when assembled to the base platform with the aid of clips, each consisting of an angular iron with a hook-like termination on its vertical section, so that the upper hook of these clips fits onto the rod of the corresponding panel and, by means of tilting it sideways, latches onto the lower surface of the crosspiece corresponding to the frame which forms part of the base platform.

This use of clips at the ends of each side panel to secure them is complemented on the central part of the panel with some U-irons, whose concave part faces downwards and which are secured by their central section to the lower rod of the side panel; the U-irons are meant to clasp the upper side of the crosspiece corresponding to the frame of the base platform, in order to tighten the rod to the crosspiece in case of possible lateral stress caused by the load of the container, in other words, by the bottles contained within.

Both the back and front panels are designed to fit in between the respective upright posts of the side panels, and all have holes at the same height and properly positioned for the introduction of the respective lamping pins, each one in the form of a cylindrical rod in the shape of a sort of rectangle open at one of its vertices and with the shorter side that is nearest to said vertex considerably slanted with respect to the general plane of the rectangle, so that by means of this inclination the insertion of the opposite side into the holes of the contiguous structures is feasible, after which by simply tilting the clamp do wnwards, the structures it connects are immediately and automatically locked and are kept immobilized both vertically and transversely. Two pairs of clamping pins are to be used to secure the back panel, and an other two pairs to secure the front panel, one for the panel itself and another for the typical top half hinged gate.

In addition, each side panel is to incorporate, near its back vertical post and located an appropriate distane from it towards the inside of the panel, a second vertical post, provided with holes the same as the first, intended to allow the position of the back panel to be adjusted, in other words, in order to move it nearer to or further from the front panel, for the purpose of allowing the container's dimensions as a whole to be adjusted according to the requirements of the two sizes or types of bottles normally used in the bottling of wines, specifically bottles of the Bordeaux or Burgundy type, so that in either case said bottles fit perfectly within the container.

Finally, and in accordance with another of the characteristics of the invention, the vertical posts of the side panels are to be greater in height than the panel itself, and their tops op en, while the vertical tubes of the base platform terminate on their lower ends in projections which taper towards their free ends, intended to "plug into" the tops of the aforementioned vertical posts of another container, when the containers are stack ed, thus ensuring that they will be transversely immobilized.

Thus, a container that can be pelletized as well as quickly and easily assembled and disassembled is achieved, completely without threaded fasteners, which in addition ensures optimal structural rigidity when assembled and whose effective dimensions can be adjusted to different types or sizes of bottles.

BRIEF DESCRIPTION OF THE DRAWINGS

To complement this description and for the purpose of allowing for better understanding of the characteristics of the invention, in accordance with the example of its preferred embodiment, a set of drawings of an illustrative and non-restrictive nature, in which the following items are represented, is attached as an integral part of this description.

DETAILED DESCRIPTION OF THE PRESENTLY PREFERRED EMBODIMENTS

Figure 1:
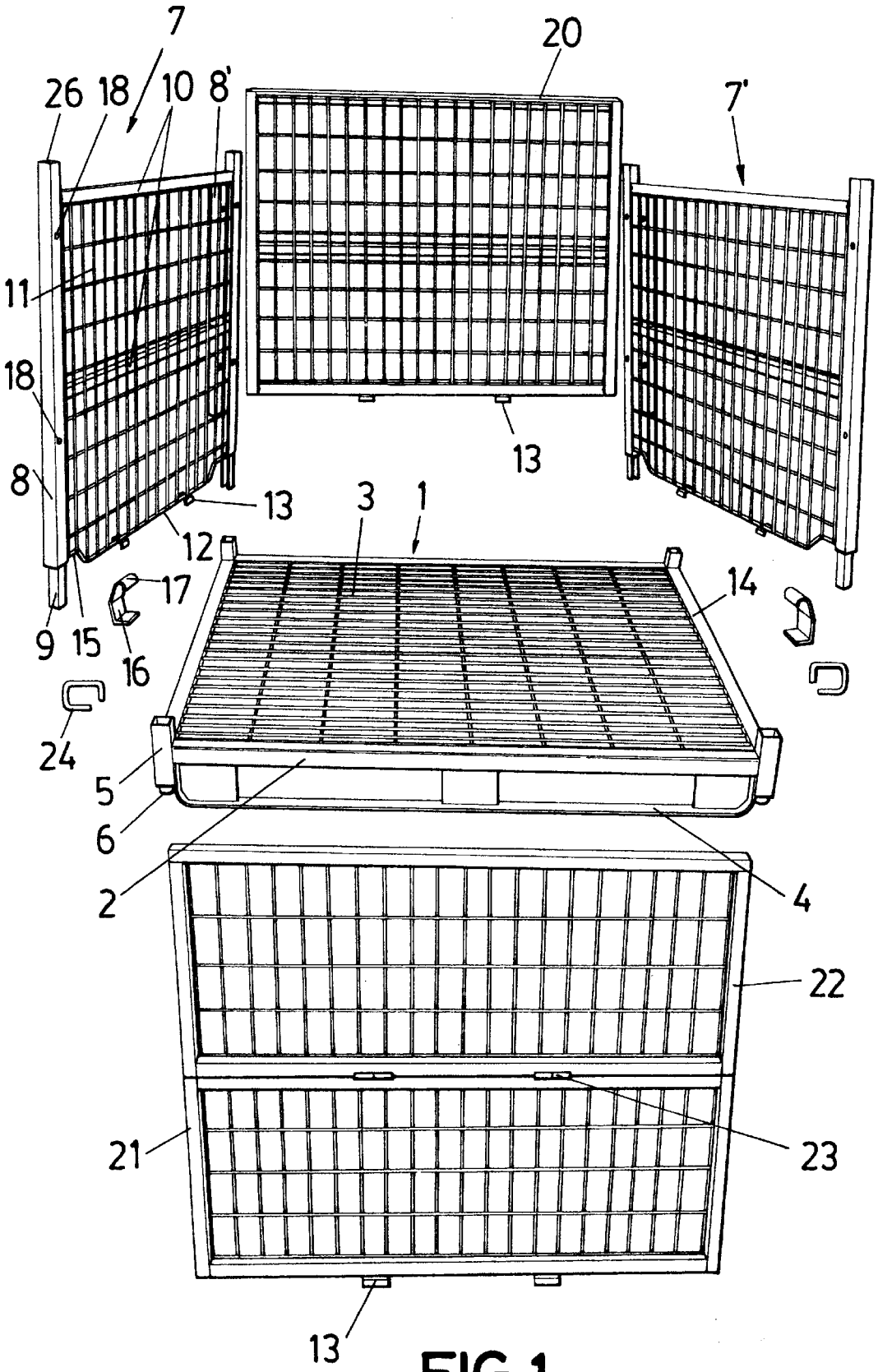
FIG. 1. —Shows an exploded perspective view of a demountable wire mesh container for bottles produced in accordance with the purpose of the present invention.
Figure 2:
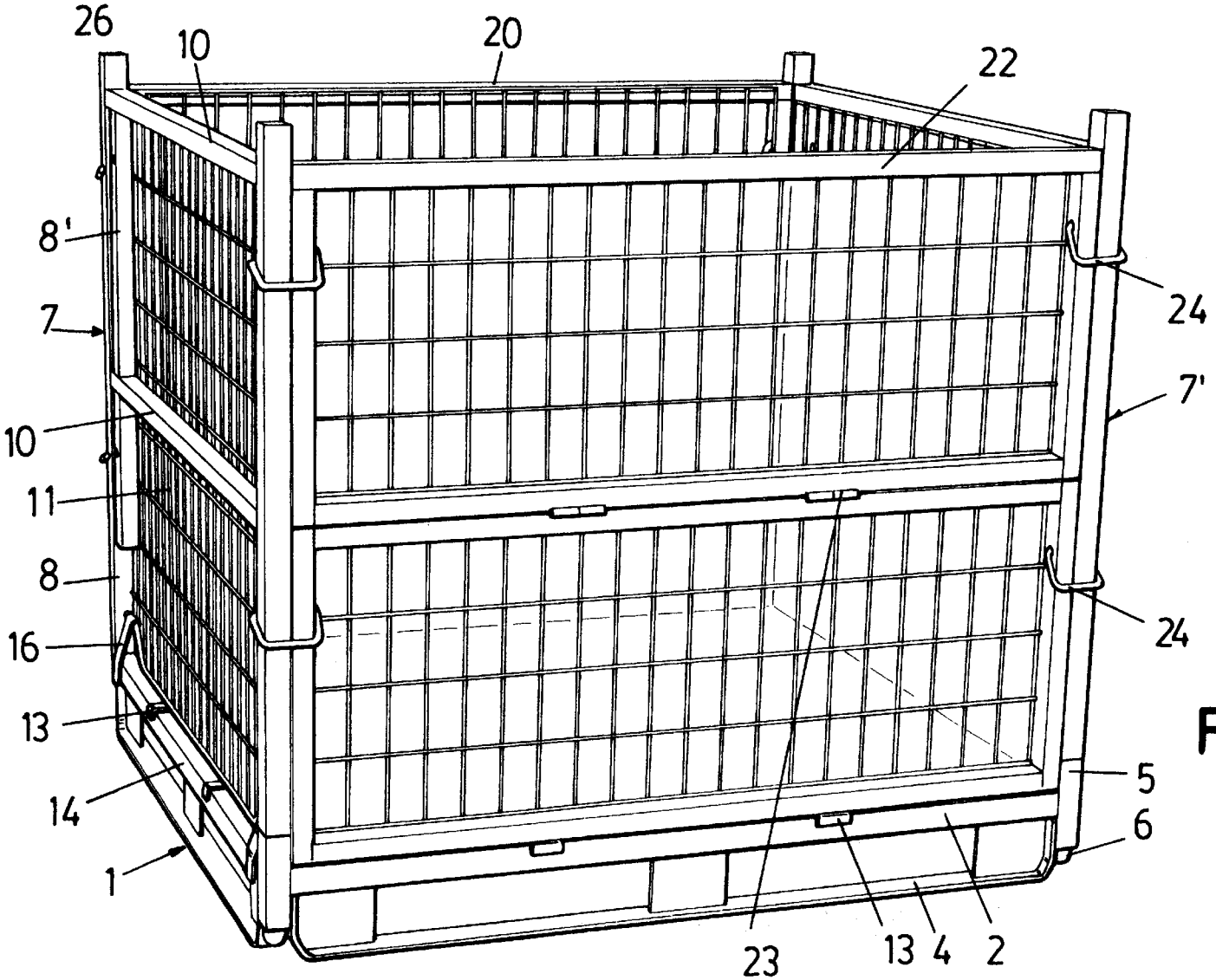
FIG. 2. —Shows, also from a perspective view, the same container of the previous figure, duly assembled.
Figure 3:
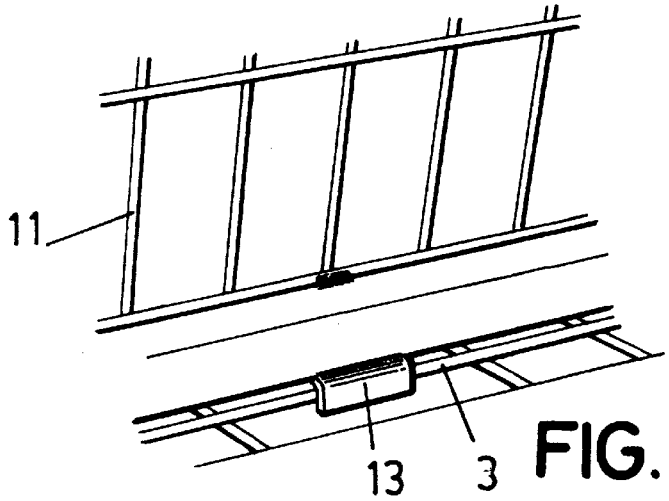
FIG. 3. —Shows a perspective detail of the previous figure, at the level of the area where one of the side panels is joined to the base platform.
Figure 4:
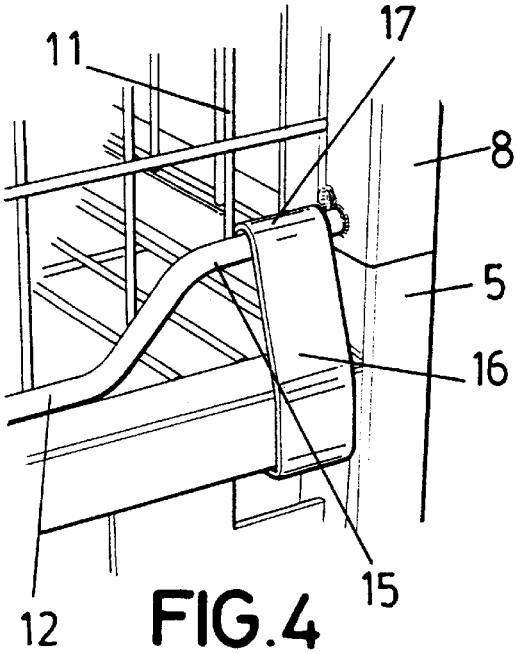
FIG. 4. —Shows another detail similar to that of the previous figure, but corresponding to one of the ends of the side panels, where the clips securing it to the base platform are located.
Figure 5:
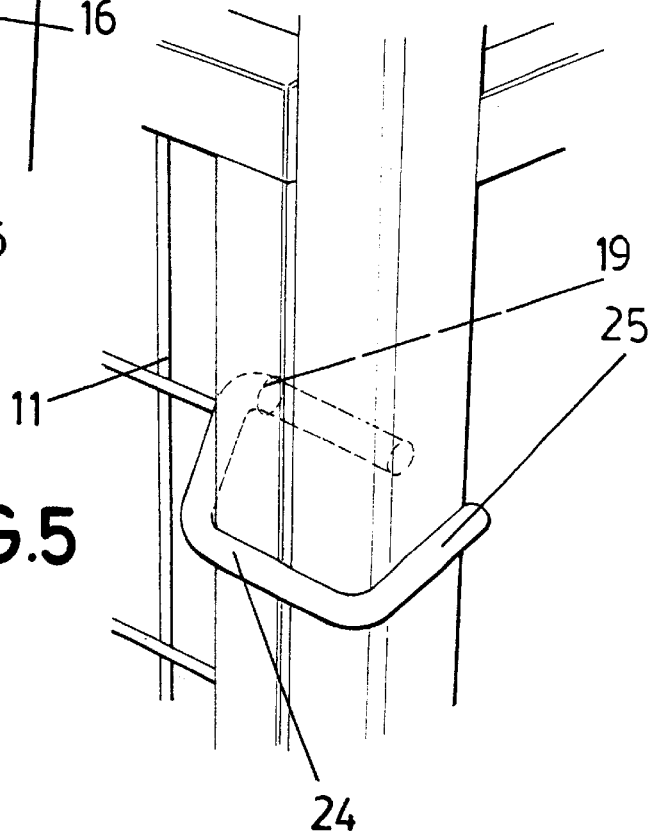
FIG. 5. —Shows a perspective detail of FIG. 2, at the level where one of the clamping pins joins the side panels to the back or front panel.
Figure 6:
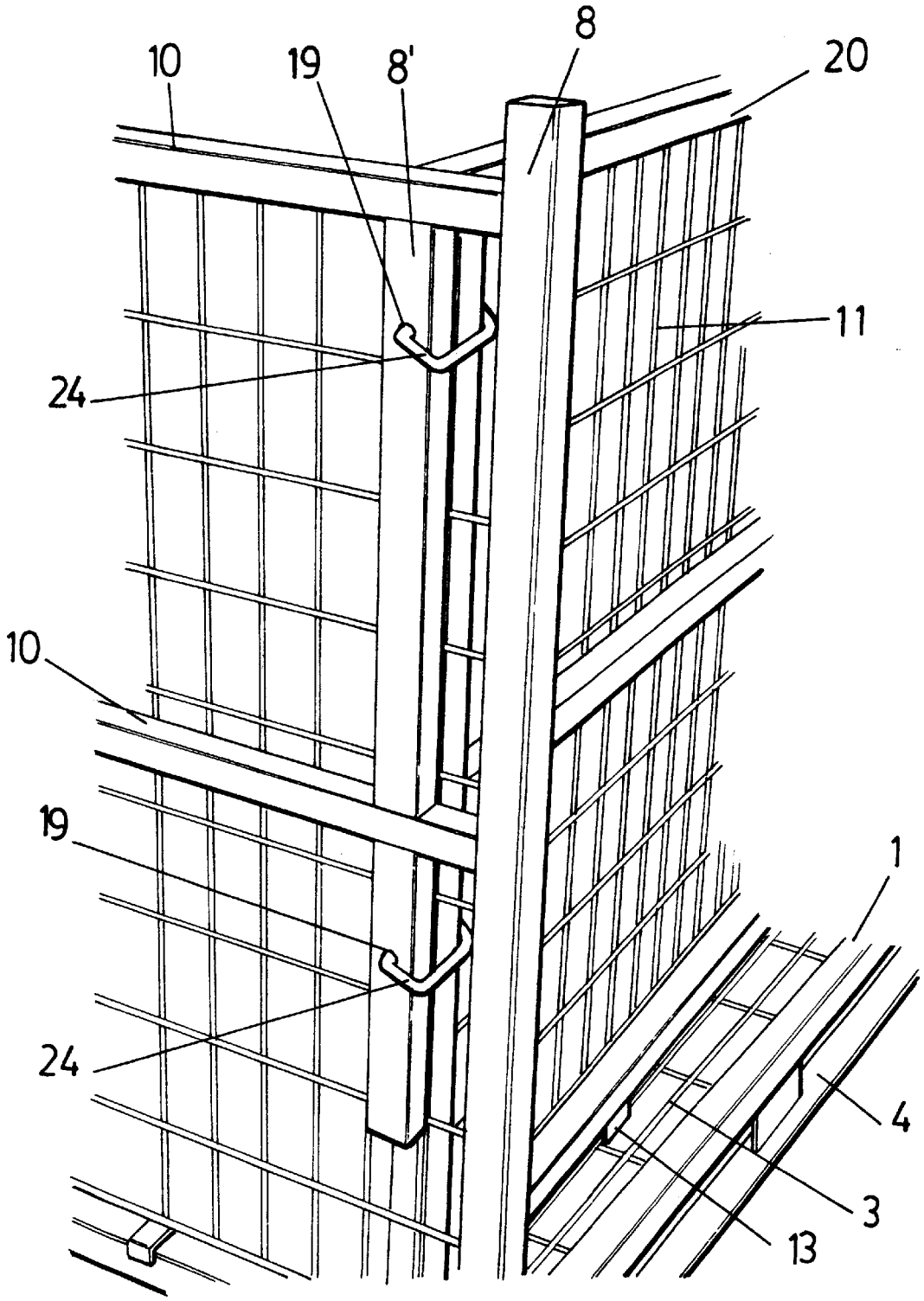
FIG. 6. —Finally, shows a perspective detail of the container, at the level of the are a where one of the side panels joins the back panel, when it becomes necessary to reduce the effective volume measurement of the container.

In looking at these figures, it can be seen how the proposed container is constructed from a base platform (1) of which a rectangular frame (2) forms part, delimiting a gridded support surface (3) for the bottles, which incorporates legs (4) on its lower surface, which convert it into a conventional-use pallet, with the special particularity that said frame (2) incorporates, at each of its vertices, vertical tubes (5), open on their upperends and having a projecting part on their lowerends (6), which will be discussed later.

These vertical tubes (5) are intended to have the side panels (7–7') of the container fitted into them; each one of these panels is constructed from two vertical posts (8), each terminating on their lowerends in a shank (9), smaller in diameter, which is the part that is to fit snugly into the tubes (5) of the base platform; the vertical posts (8) are made rigid by crosspieces (10) on which a grid (11) is placed which at the same time forms the surface which closes off the container on the sides.

These side panels (7–7'), in addition to the aforementioned crosspieces (10), incorporate a rod (12) on their loweredge, to which a pair of U-irons (13) are joined, with their concave part facing downwards, intended to act as half-clamps connecting to the crosspieces (14) of the frame (2) of the base platform (1) so that these half-clamps (13) transversely immobilize the grid (11); these rods (12) also have ends (15) which are higher than the main rod so that they can be secured to the vertical posts (8), leaving the vertical tubes (5) of the platform (1) free to serve their purpose.

These elements are definitively secured together with the aid of clips (16) which basically have an L-shape but which terminate in a type of hook (17) on their upperend. This hook is designed to latch onto the rod (12) at the latter's raised ends (15), so that once it is hooked in place, its lower section is joined to the lower surface of the crosspieces (14) of the base platform (1) by means of a simple sideways tilting motion, thus achieving an extremely quick, simple and efficient connection.

As a complement to the structure described, the vertical posts (8) of the side panels (7–7') each incorporate pairs of holes (18), considerably set apart in height and identical to other holes (19) on both the vertical posts of the back panel (20) and on those of the front panel (21) and its typical top half drop gate (22), connected to it by means of horizontal hinges (23); these holes (18–19) are intended for the insertion of the respective clamping pins (24) which, as was previously mentioned, are made up of a cylindrical rod, basically rectangular in shape, open at one of its vertices and with one of its sides (25) considerably slanted with respect to the general plane on which the other three sides are included, all in such a way that a certain position of the clamping pin (24) allows it to slide into the corresponding pair of holes (18–19), while upon later being tilted, the side or end (25) clasps the corresponding pair of vertical posts, leaving them perfectly immobilized with respect to each other, as can be particularly observed in figure (5).

The vertical posts (8) of the side panels (7–7') are greater in height than the upper crosspieces (10) of said panels and than the back (20) and front (21–22) panels, and are formed by tubes whose upperends (26) are open, so that when the containers are appropriately assembled and stacked, the projecting parts (6) of the vertical tubes (5) on each platform (1), projections which taper towards their free ends, can be fitted into the aforementioned tops (26) of the vertical posts of the container immediately below, which allows a considerable number of containers to be stacked, while remaining perfectly stable.

Finally, and as a complement to the structure described, each side panel (7–7') has a complementary inner vertical post (8'), relatively close to its rear vertical post, which has the same holes (18) for the installation of the clamping pins (24), so that the back panel (20) can be secured either to the rear vertical posts (8) or to those that are located immediately preceding them (8'), according to which type of the two previously-mentioned bottles the container is meant to hold; in whichever case, the container is perfectly adjusted in size to the type of bottle being used. These complementary vertical posts (8'), which stop before reaching the bottom of the side panels (7–7'), also provide optimal structural rigidity for the container as a whole inasmuch as they are appropriately joined to the crosspieces (10).

What is claimed is:

1. Demountable wire mesh container for bottles, which, being of the type that incorporates a base platform, formed by a rectangular frame, within which there is a grid, said platform being joined to two side panels, a back panel and a front panel, the latter having a top half drop gate and all of which are also gridded, is characterized by the fact that the base platform incorporates, at each of the vertices of its frame, vertical tubes designed to have the vertical posts of the side panels fitted into them; each of the lower ends of said vertical posts terminates in a shank which is to be snugly inserted into the aforementioned vertical tubes, and each of the vertical posts of the side panels is to incorporate on its inner surface pairs of holes aligned with others which are on both the back panel and the front panel and which are intended for the insertion of the respective clamping pins for quick coupling.

2. Demountable wire mesh container for bottles, according to claim 1, characterized by the fact that each side panel incorporates, on its lower edge, a transverse rod positioned between its vertical posts and whose ends are higher than the main part of the rod; this rod incorporates one or more U-shaped half-clamps on its central part, with their concave part facing downwards, which are intended to snugly connect to the corresponding crosspieces of the frame of the base platform; the side panels are additionally secured to the platform with the aid of L-shaped clips, the upper free end of whose vertical section is curved in the shape of a hook, which locks onto the ends of the rod on the bottom of the side panels, and whose lower section is bent inwards to fit snugly onto the lower surface of the crosspieces of the base platform, by means of tilting the clips themselves sideways once they are clamped onto the rods on the side panels.

3. Demountable wire mesh container for bottles, according to claim 1, characterized by the fact that each clamping pin is made up of a cylindrical rod, approximately rectangular in shape, open at one of its vertices, one of whose sides near that vertex is considerably slanted with respect to the general plane on which the other three sides are integrated, so that in a certain position of said clamping pin, the other side near the open vertex forms the pin proper, which can be introduced into the aligned holes on the panels and, by means of tilting or turning that side, the rest acts as a clamp, simultaneously adjusting the pair of vertical posts to be joined.

4. Demountable wire mesh container for bottles, according to any one of the preceding claims, characterized by the fact that the side panels incorporate, near their rear vertical posts, a complementary vertical post, relatively near the first and likewise provided with holes for the installation of the respective clamping pins, so that these complementary vertical posts can be used instead of the rear vertical posts, to slightly reduce the effective volume measurement of the container and adjust it to bottles of a different type or size.

5. Demountable wire mesh container for bottles, according to any one of claims 1, 2 or 3, characterized by the fact that the vertical posts of the side panels are greater in height than the mouth of the container, are hollow and have their free end open, while the vertical tubes of the base platform terminate on the bottom in projections tapering towards their free end, so that these projecting parts can be fitted into the tops of the vertical posts of the side panels when the containers are stacked, and the base platform has a pallet-like structure on the bottom which conveniently frees the aforementioned projections from contact with the ground.

6. A demountable wire mesh container for bottles, said container comprising:

a) a base platform comprising a rectangular frame and a grid, said frame having vertical tubes at each of its vertices;

b) two side panels, each of said side panels comprising at least two vertical posts and a grid, wherein the lower end of each of said vertical posts terminates in a shank, and wherein each of said vertical posts has at least two holes;

c) a back panel comprising at least two vertical posts and a grid, wherein each of said vertical posts has at least two holes; and d) a front panel comprising at least two vertical posts and a grid, wherein the top half of said front panel comprises a drop gate, and wherein each of said vertical posts has at least two holes; wherein:

said base platform is detachably joined to said side panels, said back panel, and said front panel;

said shanks are snugly and detachably fitted into said vertical tubes;

said holes on the vertical posts of said back panel are aligned with said holes on the vertical posts of said side panels; and said holes on the vertical posts of said front panel are aligned with said holes on the vertical posts of said side panels.

7. The container of claim 6, further comprising a plurality of clamping pins.

8. The container of claim 7, wherein:

each of said clamping pins is an approximately rectangular cylindrical rod having an opening at one of its vertices; wherein a first side of said cylindrical rod near said opening is slanted with respect to the plane defined by the other three sides; and a second side of said cylindrical rod near said opening can be introduced through one of said holes on one of said vertical posts, and another of said holes on an adjacent one of said vertical posts, such that said holes are in alignment, and such that by means of tilting or turning said second side, the other three sides of said clamping pin act as a clamp whereby said vertical posts are simultaneously adjusted.

9. The container of claim 6, wherein:

each of said side panels comprises, near a lower edge, a transverse rod positioned between said vertical posts, wherein the ends of said rod are higher than a main part of said rod; and wherein said rod comprises at least one U-shaped half-clamp on a central part, wherein the concave part of said half-clamp faces downwards, and wherein said half-clamp is snugly connected to a corresponding crosspiece of said frame of said base platform.

10. The container of claim 9, wherein:

said side panels are additionally secured to said platform with L-shaped clips, wherein the upper free end of said L-shaped clips is curved in the shape of a hook; and wherein:

said hook is locked onto the ends of said transverse rod near the bottom of said side panels; and a lower section of said L-shaped clips is bent inwards to fit snugly onto a lower surface of a crosspiece of said base platform.

11. The container of claim 6, wherein:

each of said side panels comprises a complementary vertical post, wherein said complementary vertical post is relatively near one of said vertical posts near the rear of said side panel, and is provided with at least one pair of holes; and said vertical posts of said back panel can be clamped to said complementary vertical posts of said side panels rather than to said vertical posts of said side panels, thereby reducing the effective volume of said container.

12. The container of claim 7, wherein:

each of said side panels comprises a complementary vertical post, wherein said complementary vertical post is relatively near one of said vertical posts near the rear of said side panel, and is provided with at least one pair of holes; and said vertical posts of said back panel can be clamped to said complementary vertical posts of said side panels rather than to said vertical posts of said side panels, thereby reducing the effective volume of said container.

13. The container of claim 9, wherein:

each of said side panels comprises a complementary vertical post, wherein said complementary vertical post is relatively near one of said vertical posts near the rear of said side panel, and is provided with at least one pair of holes; and said vertical posts of said back panel can be clamped to said complementary vertical posts of said side panels rather than to said vertical posts of said side panels, thereby reducing the effective volume of said container.

14. The container of claim 10, wherein:

each of said side panels comprises a complementary vertical post, wherein said complementary vertical post is relatively near one of said vertical posts near the rear of said side panel, and is provided with at least one pair of holes; and said vertical posts of said back panel can be clamped to said complementary vertical posts of said side panels rather than to said vertical posts of said side panels, thereby reducing the effective volume of said container.

15. The container of claim 11, wherein:

each of said side panels comprises a complementary vertical post, wherein said complementary vertical post is relatively near one of said vertical posts near the rear of said side panel, and is provided with at least one pair of holes; and said vertical posts of said back panel can be clamped to said complementary vertical posts of said side panels rather than to said vertical posts of said side panels, thereby reducing the effective volume of said container.

16. The container of claim 6, wherein:

said vertical posts of said side panels are higher than the mouth of said container, are hollow, and are open at their free ends;

the bottom of said vertical tubes terminate in projections tapering towards their free ends; and wherein said projections can be fitted into said open free ends of said vertical posts when said containers are stacked; and the bottom of said base platform has a pallet-like structure such that said projections are suspended above the ground level.

17. The container of claim 7, wherein:

said vertical posts of said side panels are higher than the mouth of said container, are hollow, and are open at their free ends;

the bottom of said vertical tubes terminate in projections tapering towards their free ends; and wherein said projections can be fitted into said open free ends of said vertical posts when said containers are stacked; and the bottom of said base platform has a pallet-like structure such that said projections are suspended above the ground level.

18. The container of claim 8, wherein:

said vertical posts of said side panels are higher than the mouth of said container, are hollow, and are open at their free ends; and the bottom of said vertical tubes terminate in projections tapering towards their free ends; and wherein said projections can be fitted into said open free ends of said vertical posts when said containers are stacked; and the bottom of said base platform has a pallet-like structure such that said projections are suspended above the ground level.

19. The container of claim 9, wherein:

said vertical posts of said side panels are higher than the mouth of said container, are hollow, and are open at their free ends;

the bottom of said vertical tubes terminate in projections tapering towards their free ends; and wherein said projections can be fitted into said open free ends of said vertical posts when said containers are stacked; and the bottom of said base platform has a pallet-like structure such that said projections are suspended above the ground level.

20. The container of claim 10, wherein:

said vertical posts of said side panels are higher than the mouth of said container, are hollow, and are open at their free ends;

the bottom of said vertical tubes terminate in projections tapering towards their free ends; and wherein said projections can be fitted into said open free ends of said vertical posts when said containers are stacked; and the bottom of said base platform has a pallet-like structure such that said projections are suspended above the ground level.

21. The container of claim 11, wherein:

said vertical posts of said side panels are higher than the mouth of said container, are hollow, and are open at their free ends;

the bottom of said vertical tubes terminate in projections tapering towards their free ends; and wherein said projections can be fitted into said open free ends of said vertical posts when said containers are stacked; and the bottom of said base platform has a pallet-like structure such that said projections are suspended above the ground level.

22. The container of claim 12, wherein:

said vertical posts of said side panels are higher than the mouth of said container, are hollow, and are open at their free ends;

the bottom of said vertical tubes terminate in projections tapering towards their free ends; and wherein said projections can be fitted into said open free ends of said vertical posts when said containers are stacked; and the bottom of said base platform has a pallet-like structure such that said projections are suspended above the ground level.

23. The container of claim 13, wherein:

said vertical posts of said side panels are higher than the mouth of said container, are hollow, and are open at their free ends;

the bottom of said vertical tubes terminate in projections tapering towards their free ends; and wherein said projections can be fitted into said open free ends of said vertical posts when said containers are stacked; and the bottom of said base platform has a pallet-like structure such that said projections are suspended above the ground level.

24. The container of claim 14, wherein:

said vertical posts of said side panels are higher than the mouth of said container, are hollow, and are open at their free ends;

the bottom of said vertical tubes terminate in projections tapering towards their free ends; and wherein said projections can be fitted into said open free ends of said vertical posts when said containers are stacked; and the bottom of said base platform has a pallet-like structure such that said projections are suspended above the ground level.

25. The container of claim 15, wherein:

said vertical posts of said side panels are higher than the mouth of said container, are hollow, and are open at their free ends;

the bottom of said vertical tubes terminate in projections tapering towards their free ends; and wherein said projections can be fitted into said open free ends of said vertical posts when said containers are stacked; and the bottom of said base platform has a pallet-like structure such that said projections are suspended above the ground level.

* * * * *